US012365514B2

(12) United States Patent
Milani

(10) Patent No.: US 12,365,514 B2
(45) Date of Patent: Jul. 22, 2025

(54) STACKABLE AND/OR NESTABLE BOX

(71) Applicant: FAMI S.R.L., Rosa' (IT)

(72) Inventor: Luca Milani, Rossano Veneto (IT)

(73) Assignee: FAMI S.R.L., Rosa' (IT)

( * ) Notice: Subject to any disclaimer, the term of this patent is extended or adjusted under 35 U.S.C. 154(b) by 29 days.

(21) Appl. No.: 18/342,360

(22) Filed: Jun. 27, 2023

(65) Prior Publication Data

US 2024/0010389 A1 Jan. 11, 2024

(30) Foreign Application Priority Data

Jul. 6, 2022 (IT) ..... 102022000014296

(51) Int. Cl.
*B65D 21/02* (2006.01)

(52) U.S. Cl.
CPC ..... *B65D 21/0213* (2013.01); *B65D 21/0233* (2013.01)

(58) Field of Classification Search
CPC ..... B65D 21/0213; B65D 21/0233; B65D 21/048
USPC ..... 206/505, 507
See application file for complete search history.

(56) References Cited

U.S. PATENT DOCUMENTS 2,994,457 A * 8/1961 Fornas ..... B65D 21/045 206/520
3,113,680 A * 12/1963 Frater ..... B65D 21/048 211/126.2
3,270,913 A * 9/1966 Bridenstine ..... B65D 21/045 206/512
3,534,866 A * 10/1970 Asenbauer ..... A47B 87/0269 211/126.2
3,734,341 A 5/1973 Levenhagen
5,071,008 A 12/1991 Hradisky
D327,560 S * 6/1992 Hradisky ..... D3/307
8,025,174 B2 * 9/2011 Martheenal ..... B65D 21/048 220/495.11
2017/0137173 A1 5/2017 Shamp et al.

FOREIGN PATENT DOCUMENTS

| | | |
|---|---|---|
| GB | 2227232 | 7/1990 |
| NL | 9200851 | 12/1993 |
| WO | 98/24701 A1 | 6/1998 |

OTHER PUBLICATIONS

Italian Search Report and Written Opinion from Italian Patent Application No. 102022000014296, Date of Completion: Mar. 1, 2023, 6 pages.

* cited by examiner

*Primary Examiner* — Andrew D Perreault
(74) *Attorney, Agent, or Firm* — Chrisman Gallo Tochtrop LLC

(57) ABSTRACT

The present invention relates to a stackable, nestable or both stackable and nestable box composed of a front panel, a rear panel and two side panels. The side panels each have a side rest surface comprising at least one guide tooth configured to realise a side centring of an upper box during the realisation of a stacking configuration. There is also preferably provided a retaining tooth capable of preventing sliding, along the front and rear panels, between two stacked boxes. There is also preferably provided a rear panel comprising a step for providing a vertical support of an upper box when stacked. Preferably, there is provided a locking tooth capable of preventing a sliding, along the side panels, between two stacked boxes.

9 Claims, 5 Drawing Sheets

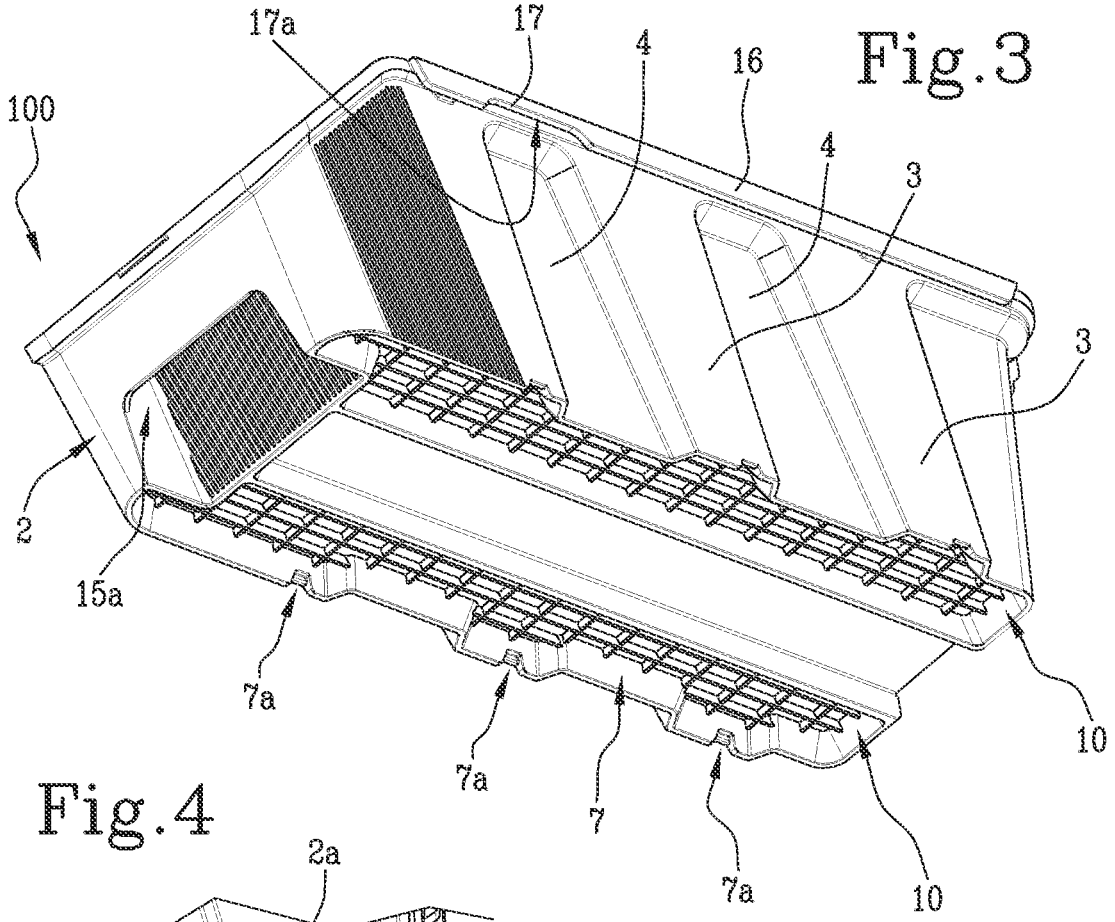
Fig.3
Fig.4
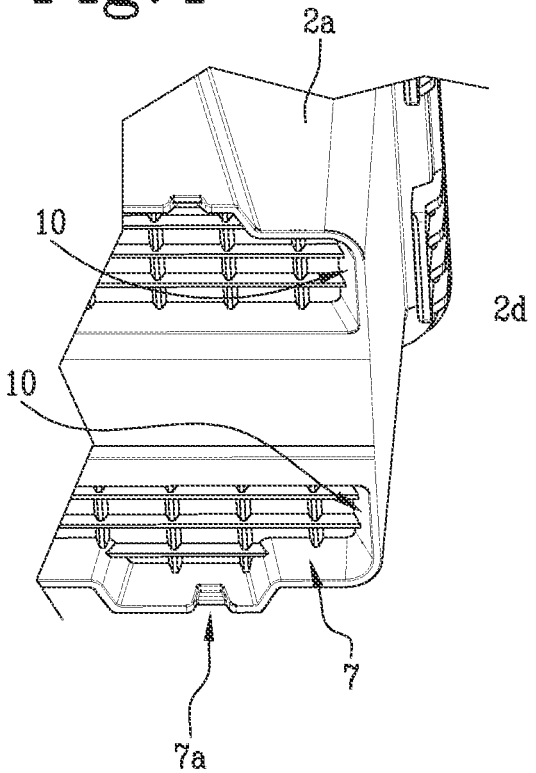
Fig.5
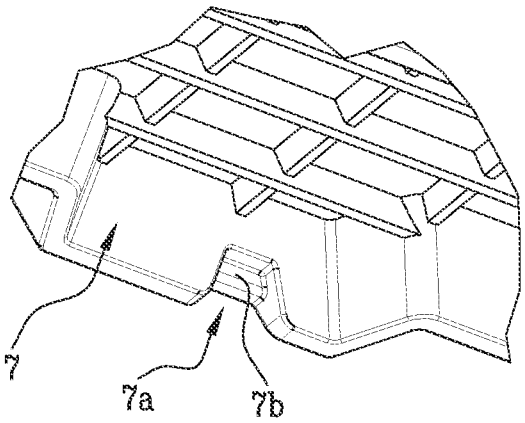

STACKABLE AND/OR NESTABLE BOX

The present invention relates to a stackable and nestable box, depending on the needs, for the temporary storage of objects of various kinds such as, for example, screws, bolts, work tools, garments or stationery.

The invention is therefore part of the sector of space-saving containers capable of being both stacked (when filled) and nested (when empty).

Generally, a space-saving container has an upper open box configuration comprising teeth and housings able to match to respective housings and teeth of an identical lower space-saving container, thus realising a stack of containers. Space-saving containers of this type comprise a bottom wall and a side wall comprising side panels, a front panel and a rear panel, substantially defining a side wall raised from the bottom wall.

Such known containers are stackable or nestable by selecting the reciprocal position between two adjacent containers, in particular starting from two different positions differently staggered from each other.

Disadvantageously, an operator, to realise a stack of space-saving containers, must pay attention to the correct positioning of the container to be stacked with respect to a lower container, in such a way as to match the teeth with the respective housings and vice versa. Incorrect positioning could lead to unwanted collapse or accidental dropping of the container above.

Even more disadvantageously, when it is necessary to withdraw an object from an intermediate container of a stack of stacked containers, great care must be taken not to inadvertently impact the containers themselves during extraction, which would consequently cause a collapse of the stack.

In order to make the stacking of space-saving containers easier, it is known, as shown in document U.S. Pat. No. 5,071,008, to provide in each of the side panels at least one step facing the inside of the container itself and which is useful to act as a rest surface for an identical upper container, when stacked. Such a step further comprises a tooth capable of realising a side locking of an identical upper container, when stacked.

Disadvantageously, the space-saving container described in document U.S. Pat. No. 5,071,008 does not allow quick and easy stacking but requires exerting particular care by the user in order to arrange exactly the upper container on the lower one.

Furthermore, document U.S. Pat. No. 5,071,008 only provides for a side locking of the stacked containers, i.e. a limitation of the sliding of a stacked container along the front and rear panels.

In this context, the technical task underlying the present invention is to propose a space-saving container that overcomes at least some of the drawbacks of the prior art mentioned above.

In particular, the object of the present invention is to propose a stackable and/or nestable box with characteristics such as to facilitate an operator during the realisation of a stack of boxes.

A further object of the present invention is to propose a stackable and/or nestable box capable of preventing the collapse of a stack made with several boxes during a withdrawal of an object therefrom.

Furthermore, an object of the present invention is to propose a stackable and/or nestable box configured such that access to each box is readily and easily available, when stacked with one or more similar boxes.

Finally, an object of the present invention is to propose a stackable and/or nestable box capable of being stacked with other space-saving containers of the same size. Furthermore, the stackable and/or nestable box is able to be stacked also with boxes with compatible dimensions, i.e. substantially close to the dimensions of the stackable and/or nestable box, and normally not stackable with each other due to different design criteria chosen to carry out the stacking.

The technical task set and the objects specified are substantially attained by a stackable and/or nestable box comprising the technical features as set out in one or more of the appended claims.

Further features and advantages of the present invention will become more apparent from the indicative, and therefore non-limiting, description of preferred but non-exclusive embodiments of a stackable and/or nestable box.

Such a description will be set out below with reference to the accompanying drawings, which are provided solely for illustrative and therefore non-limiting purposes, in which:

FIG. 3 shows a lower axonometric view of an embodiment of the stackable and/or nestable box subject-matter of the present invention;

FIG. 4 shows a detail of a lower portion in an embodiment of the stackable and/or nestable box subject-matter of the present invention;

FIG. 5 shows a detail of a lower portion of a side panel in an embodiment of the stackable and/or nestable box subject-matter of the present invention;

Figure 1:
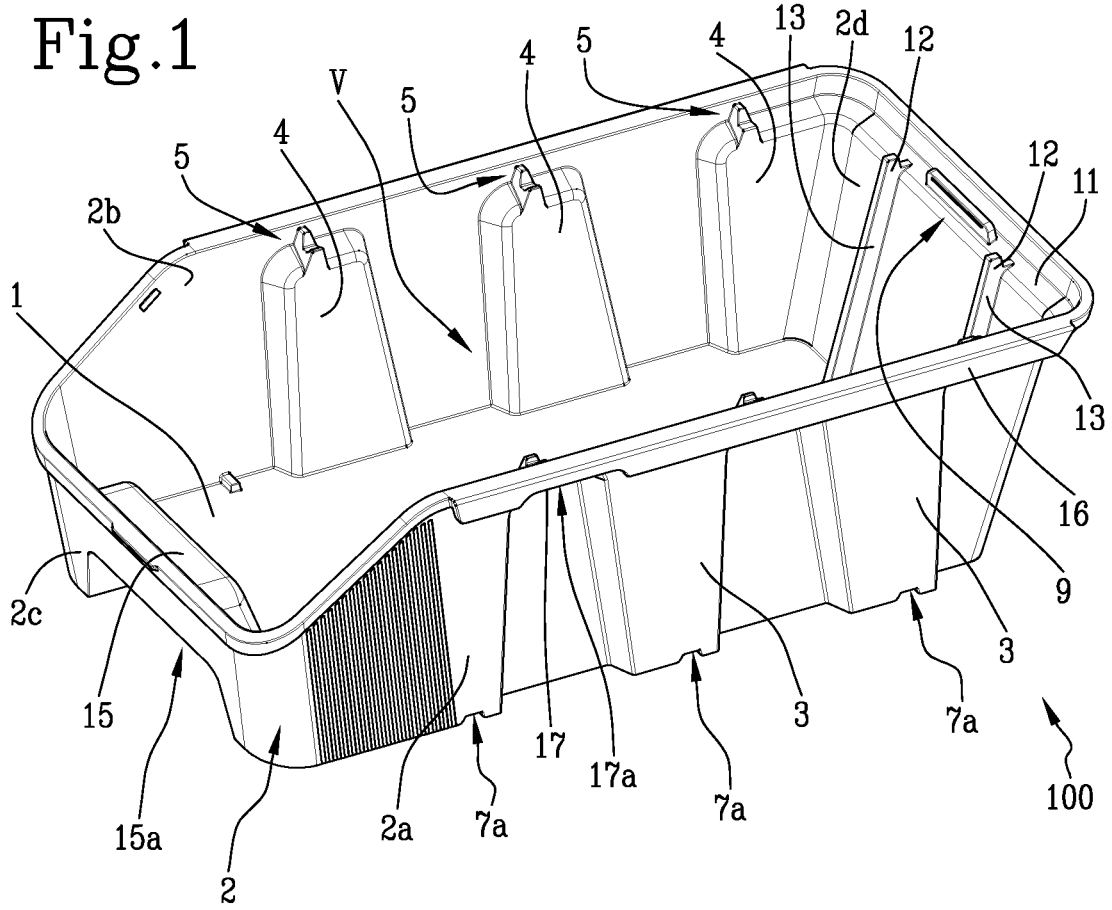
FIG. 1 shows a top axonometric view of an embodiment of the stackable and/or nestable box subject-matter of the present invention.

With reference to FIG. 1, the stackable and/or nestable box 100 subject-matter of the present invention comprises a bottom wall 1 and a side wall 2 which rises from the bottom wall 1, thus defining a containment volume "V" open above. With reference to the containment volume "V", any spatial portion comprised in said volume "V" is defined as the inside of the box 100 while any other spatial portion is defined as the outside.

Preferably, the box 100 is defined by a single monolithic body, for example made of plastic material, in particular obtained by a moulding process.

Figure 6:
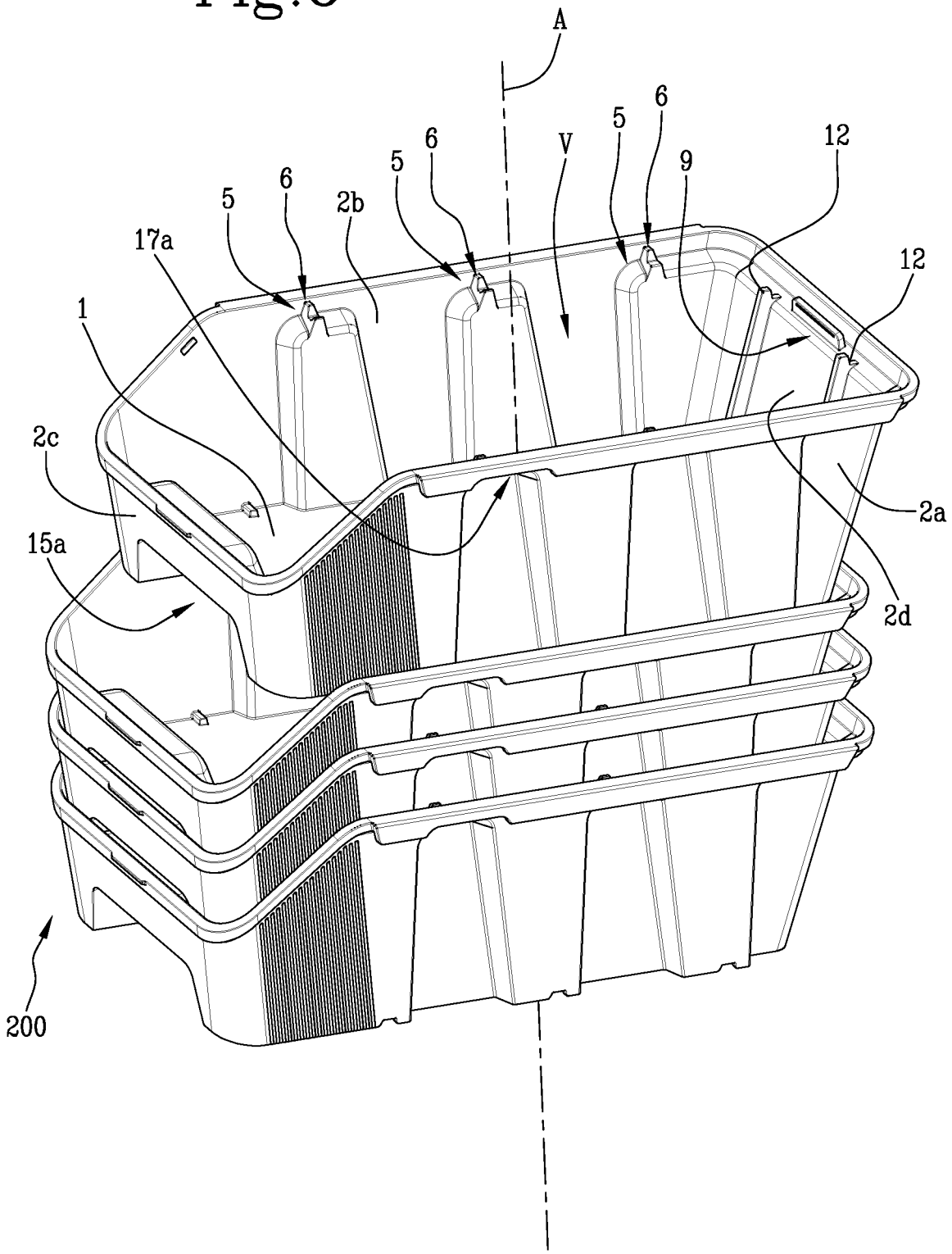
FIG. 6 shows a stack of boxes subject-matter of the present invention stacked and nested.

With reference to FIG. 6, the box 100 is configured to be stackable with other identical and equally sized boxes, for example when containing objects therein. In other words, the box 100 is configured such that it can be superimposed on another 100 forming a stack 200 along a vertical axis "A", transverse to the bottom wall 1.

The box 100 is also configured to be stacked also with boxes with compatible dimensions, i.e. substantially close to the dimensions of the stackable and/or nestable box, and normally not stackable with each other due to different design criteria chosen to carry out the stacking.

With reference to FIG. 6, the box 100 subject-matter of the present invention is further configured to be nestable within other boxes 100, for example when empty. In other words, the box 100 is configured such that it can be fitted into another lower box 100 by forming a stack 200 along the axis "A", for example saving space when the box 100 is transported or stored.

Considering a plurality of boxes 100, it is therefore possible to realise a stack 200 by arranging the boxes 100 in a first stacking configuration, in which the boxes 100 are superimposed, in a second nesting configuration, in which the boxes 100 are fitted (or nested) in each other, or in both of the above configurations.

With reference to FIG. 1, the side wall 2 of the box 100 consists of side panels 2*a* and 2*b*, of a front panel 2*c* and of a rear panel 2*d*.

More in detail, the side panels 2*a* and 2*b* each have at least a portion that is recessing 3 from the containment volume "V" and at least one portion protruding 4 towards the containment volume "V". In other words, both the panel 2*a* and the panel 2*b* have at least one recessing portion 3 and at least one protruding portion 4.

The recessing portion 3 is configured to easily fit into a corresponding recessing portion 3 of a lower box 100, when in a second nesting configuration.

As regards the first stacking configuration, the protruding portion 4 comprises at least one side rest surface 5, useful for defining a vertical support of an upper box 100. In other words, both the side panel 2*a* and the side panel 2*b* comprise at least one protruding portion 4, in turn comprising at least one side rest surface 5.

In particular, each recessing portion 3 of the box 100 is configured to rest on a corresponding side rest surface 5 of a lower box 100, when in a first stacking configuration.

Figure 2:
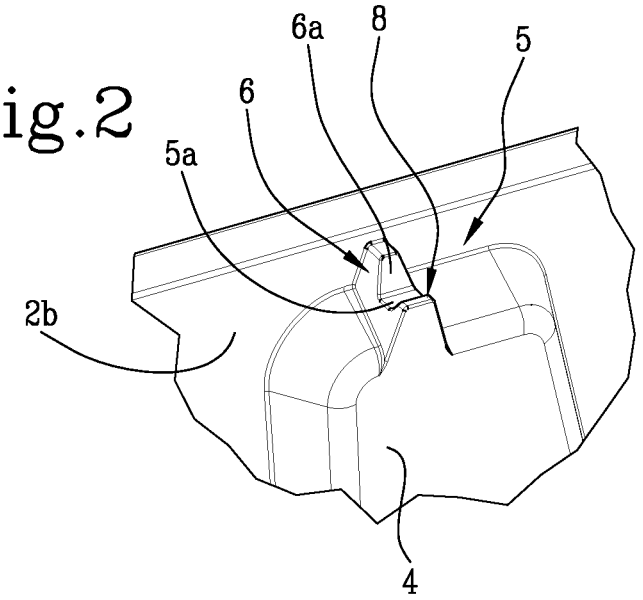
FIG. 2 shows a detail of a side panel in an embodiment of the stackable and/or nestable box subject-matter of the present invention.

As illustrated in FIG. 2, the side rest surface 5 comprises a base surface 5*a* destined to restingly receive a recessing portion 3 of an upper box 100, when in a first stacking configuration. In other words, when the box 100 is stacked on another lower box 100, a recessing portion 3 of the first rests on the base surface 5*a* of the second.

The side rest surface 5 further comprises a guide tooth 6 defining a guide surface 6*a*, as illustrated in FIG. 2.

In detail, the guide surface 6*a* is inclined towards the base surface 5*a* and faces the containment volume "V".

Preferably the guide tooth 6 is adjacent to the respective side panel 2*a* or 2*b* and progressively moves away therefrom towards the base surface 5*a*, i.e. towards the bottom wall 1. In other words, the inclination of the guide surface 6*a* is greater than the inclination of the respective side panel 2*a* or 2*b*.

In greater detail, the guide surfaces 6*a* are opposite and converging towards the base surface 5*a*, thus defining a side self-centring of a box 100 when it is stacked on a lower box 100.

In other words, both the side panel 2*a* and the side panel 2*b* comprise at least one side rest surface 5 comprising in turn a guide tooth 6, consequently, the guide surfaces 6*a* defined by the latter are opposite and converging with each other in the side panels 2*a* and 2*b*. Such convergence, during the realisation of the first stacking configuration, defines a side self-centring of a box 100, when it is stacked on a lower box 100.

In other words, considering the first stacking configuration, the guide surfaces 6*a* of a lower box 100 define a temporary rest for an upper box 100, such rest being made definitive and stable when an upper box 100 comes to rest on the respective base surface 5*a* of a lower box 100.

The guide surface 6*a* of the box 100 is then configured to define a gradual sliding of the recessing portion 3 of an upper box 100 towards the base surface 5*a*, the latter being intended to restingly receive the recessing portion 3 of an upper box 100, defining therewith a sliding coupling along the side panels 2*a*, 2*b*.

The conformations of guide surface 6*a* and base surface 5*a* allow the box 100 to be stacked with other boxes with compatible dimensions, i.e. with other boxes of similar dimensions and which are normally not stackable with each other due to the different design criteria for realising the stacking means.

More in detail, the guide tooth 6 has a length, measured along the side panel 2*a* or 2*b* from the bottom wall 1 to the front panel 2*c*, lower than the length, measured in the same way, of the corresponding protruding portion 4.

Preferably the length of the guide tooth 6 is less than half the length of the corresponding protruding portion 4.

With reference to FIGS. 3 and 4, in order to allow the realisation of the first stacking configuration, the box 100 preferably comprises a lower side edge 7 configured to rest on the base surface 5*a* of a lower box 100.

In particular, the lower side edge 7 is defined by an extension of the side panels 2*a* and 2*b* downwards from the bottom wall 1 in such a way as to follow the profile defined by the recessing 3 and protruding 4 portions. In other words, the recessing portions 3 and the protruding portions 4 extend downward from the bottom wall 1 defining the lower side edge 7.

During the realisation of the first stacking configuration, therefore, the lower side edge 7 of the box 100 gradually slides on the guide surface 6*a* of a lower box 100, thus realising a side self-centring, and then rests stably on the base surface 5*a* thereof.

In other words, the side rest surfaces 5 of the box 100, by means of the guide tooth 6 and the respective guide surface 6*a*, define a side self-centring of an upper box 100 during its stacking by guiding the lower side edge 7 thereof towards the base surface 5*a*.

The guide surface 6*a* of the box 100 is then configured to define a gradual sliding of the lower side edge 7 of an upper box 100 towards the base surface 5*a*, the latter being intended to restingly receive the lower side edge 7 of an upper box 100, defining therewith a sliding coupling along the side panels 2*a*, 2*b*.

Advantageously, therefore, the guide tooth 6 and the respective guide surface 6*a* are adapted to facilitate the realisation of the first stacking configuration.

When in the first stacking configuration, the lower side edge 7 of the box 100 rests on the base surface 5*a* of a lower box 100 defining therewith a sliding coupling along the side panels 2*a* and 2*b*.

In other words, when in the first stacking configuration, the side rest surfaces 5 of the box 100 realise, by means of the base surface 5*a*, a vertical support of an upper box 100 and a sliding coupling, with the lower side edge 7 of an upper box 100, along the side panels 2*a* or 2*b*.

With reference to FIG. 2, preferably, the side rest surface 5 further comprises at least one retaining tooth 8, facing the guide tooth 6 and preferably adjacent to the base surface 5*a*.

The retaining tooth 8 of the box 100 is configured to realise a side locking of an upper box 100, when in the first stacking configuration.

In other words, the retaining tooth 8 of the box 100 is configured to limit a sliding, along the front 2*c* and rear 2*d* panels, of an upper box 100 and in the first stacking configuration.

In greater detail, the retaining tooth 8 of the box 100 defines, together with the base surface 5*a* and the guide tooth 6, a housing adapted to receive the lower side edge 7 of an upper box 100, when in the first stacking configuration. Consequently, the retaining tooth 8 defines, together with the base surface 5*a* and the guide tooth 6, a prismatic or undercut coupling with the lower side edge 7 of an upper box 100, when in the first stacking configuration.

In other words, considering a lower box 100 and an upper box 100 in first stacking configuration, the former not only supports the latter vertically by means of its base surface 5*a*, which restingly receives the lower side edge 7 of the latter, but also locks the latter laterally by means of its retaining tooth 8, which constrains the lower side edge 7 of the latter to remain rested on the base surface 5*a* of the former.

Advantageously, moreover, considering once again a lower box 100 and an upper box 100 in first stacking configuration, the retaining tooth 8 of the first prevents the side wall 2 thereof from excessively deforming due to the weight of the second.

With reference to FIGS. 3, 4 and 5, preferably, the lower side edge 7 of the box 100 comprises a recess 7*a* in vertical alignment with a respective base surface 5*a*.

In greater detail, the recess 7*a* of the box 100 is configured to be arranged astride, therefore to embrace, a respective base surface 5*a* of a lower box 100, when in a first stacking configuration. Consequently, the base surface of a lower box 100 is housed within the recess 7*a* of an identical upper box, when in first stacking configuration. In other words, the recess 7*a* limits a relative sliding along the side panels 2*a* and 2*b* between two boxes 100 when stacked on top of each other.

Advantageously therefore, the recess 7*a* ensures a greater stability of a stack 200.

Even more preferably, the recess 7*a* defines a side cavity 7*b*, turned internally, shown in FIG. 5, in the lower side edge 7.

The side cavity 7*b* of the box 100 is configured to receive the retaining tooth 8 of an upper box 100, when in the first stacking configuration.

Advantageously, the insertion of the retaining tooth 8 of a lower box 100 into a respective side cavity 7*b* of an upper box 100 ensures greater stability of a stack 200. In fact, the cavity 7*b* further limits a relative sliding along the side panels 2*a* and 2*b* between two boxes 100 when stacked on top of each other.

With regard to the side panels 2*a* and 2*b*, an embodiment of the box 100 is contemplated in which the side rest surface 5 comprises firstly a base surface 5*a*, intended to restingly receive a lower portion of an upper box 100 in a first stacking configuration, and secondly a guide tooth 6, configured to realise a side self-centring of an upper box 100 during the realisation of the first stacking configuration.

A further embodiment of the box 100 is also contemplated in which the side rest surface 5 comprises, in addition to the base surface 5*a* and the guide tooth 6, also the retaining tooth 8.

Preferably, the guide tooth 6 and the retaining tooth 8 have a height, measured by the bottom wall 1 rising along the respective side panel 2*a* or 2*b*, lower than the height of the side panels 2*a*, 2*b* measured in the same way.

Advantageously, this feature allows to place in the first stacking configuration, with a box 100 subject-matter of the present invention, any identical box and having the same dimensions, even if this is not configured to be stackable with other boxes identical thereto.

With reference to FIG. 1, in order to allow the realisation of the first stacking configuration, the box 100 preferably comprises a step 11 at an upper portion of the rear panel 2*d*.

The step 11 is turned towards the containment volume "V" and is configured to restingly receive a lower portion of an upper box 100 when in the first stacking configuration.

In other words, when an upper box 100 and a lower box 100 are in a first stacking configuration, the lower side edge 7 of the first rests on the base surface 5*a* of the second and a lower rear portion of the first rests on the step 11 of the second.

In this case, there is therefore provided a vertical support of an upper box 100 both laterally, by means of the base surface 5*a* of a lower box 100, and, behind, by means of the step 11 of a lower box 100.

Figure 9:
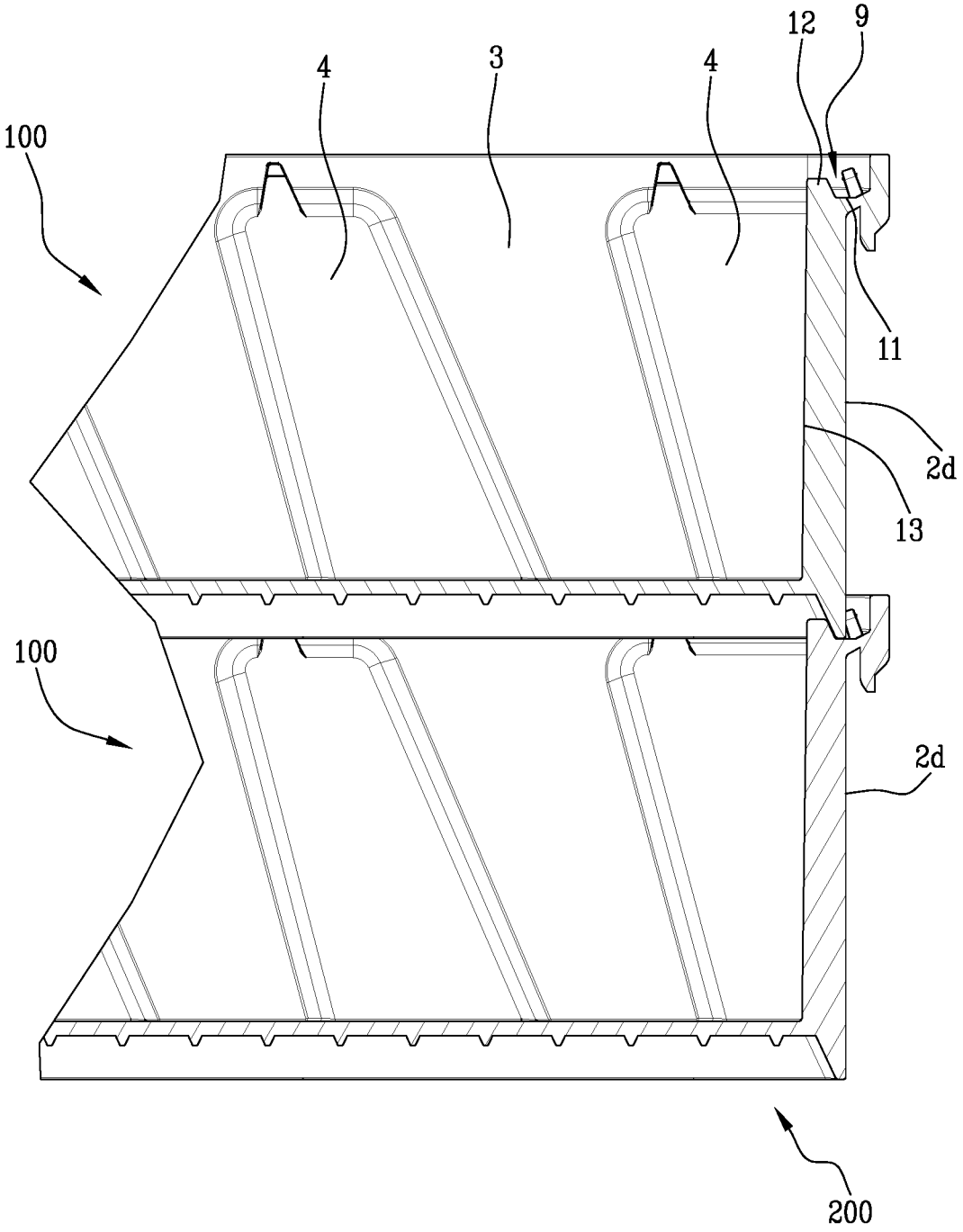
FIG. 9 shows a sectional view according to trace IX-IX of FIG. 7.

With reference to FIGS. 1 and 9, in order to allow the realisation of the first stacking configuration, the rear panel 2*d* of the box 100 comprises above a receiving portion 9. Said receiving portion 9 is preferably defined on the mentioned step 11.

With reference to FIGS. 3 and 4, the rear panel 2*d* of the box 100 extends downwards from the bottom wall 1 defining a lower rear edge 10, configured to fit within the receiving portion 9 of a lower box 100, when in first stacking configuration.

Preferably, the rear panel 2*d* of the box 100 comprises above, at the receiving portion 9, a locking tooth 12 facing the containment volume "V" and defining the receiving portion 9.

Even more preferably, the rear panel 2*d* of the box 100 comprises two locking teeth 12.

In particular, the locking tooth 12 is far from the rear panel 2*d* and, as shown in FIG. 9, defines the receiving portion 9 of the box 100, configured to retain, stably and in a predetermined position, a corresponding lower portion of an upper box 100 when in a first stacking configuration.

The receiving portion 9 is then defined behind by an end portion of the rear panel 2*d* and in front by one or more locking teeth 12.

In other words, the locking tooth 12 defines a housing adapted to receive the lower rear edge 10 of an upper box 100, and to retain it stably and in a predetermined position.

The locking tooth 12 then allows the lower rear edge 10 of an upper box 100 to be engaged, advantageously providing a useful support to facilitate the realisation of the stacking configuration.

Considering the box 100 in the first stacking configuration, there is consequently provided a front locking thereof operated by the locking tooth 12 of a lower box 100, i.e. a limitation to the sliding of the box 100 along the side panels 2*a* and 2*b*.

Preferably the receiving portion 9 further provides a vertical support of an upper box 100 in first stacking configuration.

In this case, as shown in FIG. 1, there is preferably provided a step 11 comprising a locking tooth 12.

Even more preferably the step 11 comprises two locking teeth 12, arranged at the same distance from a central point of the step 11.

In particular, the locking tooth 12 is far from the rear panel 2*d* and defines with the step 11 the receiving portion 9 of the box 100, configured to provide a vertical support and retain stably and in a predetermined position a corresponding lower portion of an upper box 100 when in the first stacking configuration.

In other words, the locking tooth 12 defines, with the step 11, a housing adapted to receive the lower rear edge 10 of an upper box 100 providing a vertical support thereof and retaining it stably and in a predetermined position.

More in detail, the locking tooth 12 allows to hook the lower rear edge 10 of an upper box 100, advantageously providing a support useful to facilitate the realisation of the stacking configuration.

In this case, if an upper box 100 and a lower box 100 are in the first stacking configuration, the lower side edge 7 of the first rests on the base surface 5*a* of the second, furthermore, the lower rear edge 10 of the first rests on the step 11 of the second, fitting into the respective receiving portion 9.

Considering the first stacking configuration, there is therefore provided a vertical support of an upper box 100 both laterally, by means of the base surface 5*a* of a lower box 100, and behind, by means of the step 11 of a lower box 100.

Considering the first stacking configuration, there is further provided a front locking operated by the locking tooth 12 of a lower box 100, i.e. there is provided a limitation to the sliding of an upper box 100 along the side panels 2*a* and 2*b*.

In other words, considering the first stacking configuration, with front locking it is meant that the locking tooth 12 of a lower box 100 limits the sliding on its base surface 5*a* of a stacked upper box 100, from the rear panel 2*d* towards the front panel 2*c*.

Figure 8:
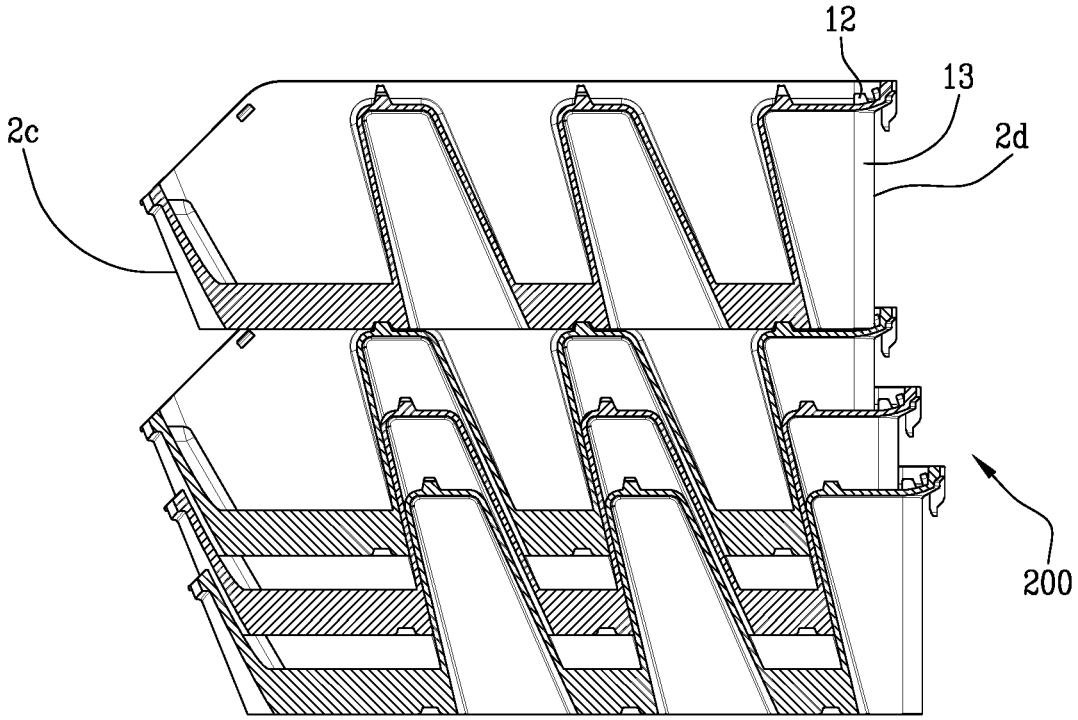
FIG. 8 shows a sectional view according to trace VIII-VIII of FIG. 7.

Preferably, the locking tooth 12 defines a corresponding rib 13, illustrated in FIGS. 1, 8 and 9.

Even more preferably, the rib 13 extends from the locking tooth 12 towards the bottom wall 1 preferably up to the bottom wall 1 itself and acts as a spacer between the rear panel 2*d* of the box 100 and the rear panel 2*d* of an upper box 100, when in a second nesting configuration.

In particular, the rib 13 is in relief from the rear panel 2*d* towards the containment volume "V".

Figure 7:
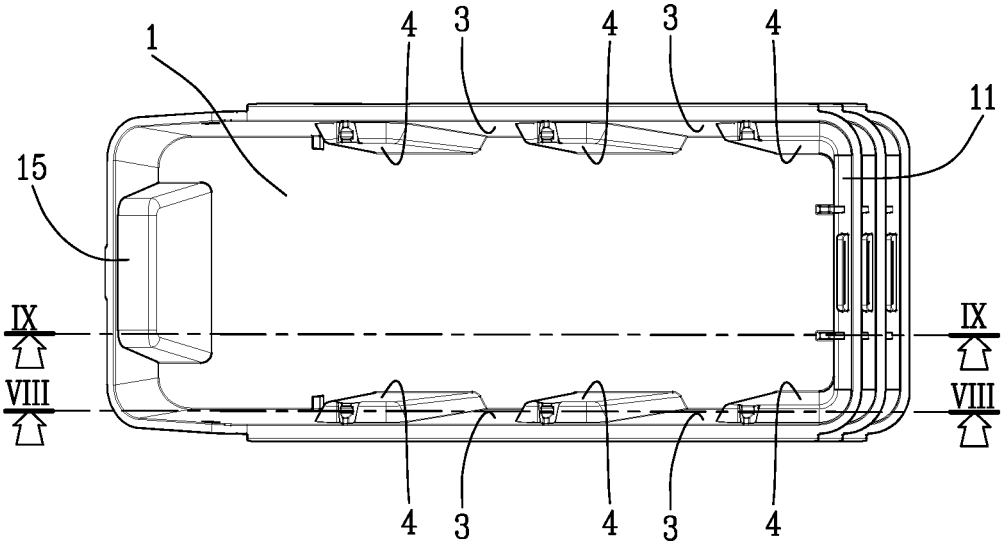
FIG. 7 shows a top view of a stack of boxes subject-matter of the present invention.

In other words, as shown in FIG. 7, when an upper box 100 is nested inside a lower box 100, the rib 13 of the second box preferably comes into contact with an outer portion of the rear panel 2*d* of the first box and avoids direct contact between the rear panels 2*d* of the two nested boxes 100.

As regards the rear panel 2*d*, an embodiment of the box 100 is contemplated comprising only a step 11, configured to provide a vertical support of an upper box 100 when in the first stacking configuration.

An embodiment of a box 100 is also contemplated in which the rear panel 2*d* comprises at least one locking tooth 12 configured to define a receiving portion 9 capable of retaining, stably and in a predetermined position, the lower rear edge 10 of an upper box 100, when in a first stacking configuration.

A further contemplated embodiment relates to a box 100 in which the step 11 comprises at least one locking tooth 12.

With reference to FIGS. 1 and 6, the front panel 2*c* of the box 100 has a height, measured by rising from the bottom wall along the front panel 2*c*, lower than a height of the rear panel 2*d*, measured by rising from the bottom wall 1 along the rear panel 2*d*.

Furthermore, the front panel 2*c* has a height, measured by rising from the bottom wall 1 along the front panel 2*c*, lower than a height of the rear panels 2*a* and 2*b*, measured by rising from the bottom wall 1 respectively along the rear panels 2*a* and 2*b*.

In other words, the front panel 2*c* is lower than the other panels 2*a*, 2*b*, 2*d* of the box 100.

Advantageously, this feature makes access to the box 100 readily and easily available, when stacked with one or more boxes 100. Considering a stack 200 of boxes 100 in first stacking configuration, in fact, the lower height of the front panel 2*c* allows defining, between the front panel 2*c* of a lower box 100 and the bottom wall 1 of an upper box 100, an access portion to the contents of the box 100.

In order to facilitate the manual transport of the box 100, a gripping portion and a gripping portion 17*a* are also provided.

With reference to FIGS. 1 and 7, the front panel 2*c* has an indentation 15 towards the containment volume "V", said indentation defining, outside the box 100, the respective gripping portion 15*a*.

With reference to FIGS. 1 and 3, the side panels 2*a* and 2*b* have a side crown 16 extending in the opposite direction to the containment volume "V". By side crown is meant an upper portion of the side panels 2*a* and 2*b* having firstly a folding outward of the box 100 and secondly a folding towards the bottom wall 1 of the box 100.

In detail, the side crown 16 has an indentation 17, advantageously useful for realising the gripping portion 17*a*, preferably the side crown 16 is compatible with metal guides. In other words, the side crown 16 and more particularly the side portion at least partially defining the gripping portion 17*a*, is shaped so as to be slidable on metal guides.

The present invention reaches the proposed object, overcoming the complained disadvantages of the prior art.

Advantageously, the box 100 subject-matter of the present invention, thanks to the guide tooth 6 and to the respective guide surface 6*a*, as well as thanks to the rear receiving portion 9, is able to facilitate the realisation of a stack 200 of boxes 100.

Even more advantageously, the locking tooth 12 provides additional support for an operator during the realisation of a stack 200 of boxes 100.

Advantageously, the box 100, by means of its locking tooth 12 and its retaining tooth 8, is able to prevent the collapse of a stack 200 made with several boxes 100 during a withdrawal of an object therefrom. Faced with a possible impact by an operator, in fact, the locking tooth 12 provides stability along the side panels 2*a* and 2*b* while the retaining tooth 8 provides stability along the front 2*c* and rear 2*d* panels.

Advantageously, the lower height of the front panel 2*c* with respect to the side panels 2*a*, 2*b* and with respect to the rear panel 2*d* allows an operator to readily and easily access each box, when stacked with one or more boxes 100.

Advantageously, the lower height of the guide tooth 6 and the retaining tooth 8 makes the box 100 stackable with other space-saving containers normally not stackable between them.

The invention claimed is:

1. A stackable and nestable box (100) comprising a bottom wall (1);

a side wall (2) rising from said bottom wall (1), said side wall (2) being defined by side panels (2*a*, 2*b*), a front panel (2*c*), and a rear panel (2*d*), said side wall (2) defining with said bottom wall (1) a containment volume (V) open at a top, wherein each of said side panels (2*a*, 2*b*) each has at least a recessed portion (3) which is recessed from said containment volume (V) and at least one projecting portion (4) which projects towards the containment volume (V), wherein each protruding portion (4) comprises at least one side rest surface (5), wherein each recessed portion (3) is configured to rest on a corresponding side rest surface (5) of a lower identical box in a first stacking configuration and to fit within a corresponding recessed portion (3) of a lower identical box in a second nesting configuration, wherein each side rest surface (5) comprises at least one base surface (5*a*) configured to support a lower portion of an upper identical box, when in said first stacking configuration, and wherein each side rest surface (5) defines at least one guide tooth (6) defining a guide surface (6*a*) inclined towards said base surface (5*a*) and facing said containment volume (V), wherein the guide surface (6*a*) of each of the side rest surfaces (5) are opposite to each other and are converging towards the base surface (5*a*) so as to define a side self-centring of an identical upper box during the realisation of said first stacking configuration, wherein said side panels (2*a*, 2*b*) further extend downwards from said bottom wall (1) defining a lower side edge (7) configured to gradually slide on said guide surface (6*a*) of a lower identical box during the realisation of said first stacking configuration and, when in said first stacking configuration, to rest on said base surface (5*a*) of a lower identical box, realising a sliding coupling along said side panels (2*a*, 2*b*), wherein said lower side edge (7) comprises, in vertical alignment with a respective base surface (5*a*), a recess (7*a*) configured to be arranged astride a respective base surface (5*a*) of a lower identical box in such a way that, in said first stacking configuration, the base surface (5*a*) of said lower identical box is housed within said recess (7*a*), and wherein said recess (7*a*) further defines a side cavity (7*b*), turned internally, of said lower side edge (7) configured to receive a retaining tooth (8) of the respective side rest surface (5) of an identical lower box, when in said first stacking configuration.

2. The box (100) according to claim 1, wherein said guide tooth (6) has a length, measured along the side panel (2*a* or 2*b*) from the bottom wall (1) to the front panel (2*c*), less than a length of the corresponding protruding portion (4).

3. The box (100) according to claim 1, wherein said side rest surface (5) comprises at least one retaining tooth (8) facing said guide surface (6*a*) and configured to define a side locking of an identical upper box when in said first stacking configuration, said retaining tooth (8) defining, together with said base surface (5*a*) and said guide surface (6*a*), a prismatic coupling or with undercut with said lower side edge (7) of an identical upper box, when in said first stacking configuration.

4. The box (100) according to claim 1, wherein said rear panel (2*d*) comprises a step (11) facing the containment volume (V) and having at the top a receiving portion (9) comprising one or more locking teeth (12) configured to stably retain in a predetermined position a corresponding lower portion of an upper identical box in said first stacking configuration so as to define a rear centring of an upper identical box during the realisation of said first stacking configuration.

5. The box (100) according to claim 4, wherein each locking tooth (12) defines a corresponding rib (13) in relief rising from the rear panel (2*d*) towards the containment volume (V) and extending along the rear panel (2*d*) towards said bottom wall (1), the rib (13) defining a spacer element between said rear panel (2*d*) and the rear panel (2*d*) of an identical upper box, when in said second nesting configuration.

6. The box (100) according to claim 3, wherein said guide tooth (6) and said retaining tooth (8) have a height, measured from said bottom wall (1) rising along said side panels (2*a*, 2*b*), lower than the equally measured height of said side panels (2*a*, 2*b*), said guide tooth (6) and said retaining tooth (8) allowing a stacking of said box (100) with any box of compatible dimensions normally not stackable with the box (100).

7. The box (100) according to claim 1, wherein said rear panel (2*d*) comprises at the top a receiving portion (9) configured to stably retain in a predetermined position a corresponding lower portion of an upper box, when in said first stacking configuration, so as to define a rear centring of an upper box during the realisation of said first stacking configuration.

8. The box (100) according to claim 7, wherein said rear panel (2*d*) comprises a step (11) facing the containment volume (V) and having at the top said receiving portion (9), said step (11) comprising one or more locking teeth (12) defining a stable retention of said lower rear edge (10).

9. The box (100) according to claim 8 wherein each locking tooth (12) defines a corresponding rib (13) in relief rising from the rear panel (2*d*) towards the containment volume (V) and extending along the rear panel (2*d*) towards said bottom wall (1), said rib (13) defining a spacer element between said rear panel (2*d*) and said rear panel (2*d*) of an identical upper box, when in said second nesting configuration.

* * * * *